US011885137B1

(12) United States Patent
Smitchko

(10) Patent No.: US 11,885,137 B1
(45) Date of Patent: Jan. 30, 2024

(54) CABLE SYSTEM FOR ATTACHING CABLES BETWEEN TWO STRUCTURES

(71) Applicant: Daniel J. Smitchko, Boise, ID (US)

(72) Inventor: Daniel J. Smitchko, Boise, ID (US)

( * ) Notice: Subject to any disclaimer, the term of this patent is extended or adjusted under 35 U.S.C. 154(b) by 0 days.

(21) Appl. No.: 18/086,853

(22) Filed: Dec. 22, 2022

Related U.S. Application Data

(62) Division of application No. 16/596,980, filed on Oct. 9, 2019, now Pat. No. 11,629,502.

(60) Provisional application No. 62/742,995, filed on Oct. 9, 2018.

(51) Int. Cl.
*E04F 11/18* (2006.01)

(52) U.S. Cl.
CPC ..... *E04F 11/1817* (2013.01); *E04F 11/1859* (2013.01); *E04F 2011/1889* (2013.01)

(58) Field of Classification Search
CPC ..... E04F 11/1817; E04F 11/1859; E04F 2011/1889
See application file for complete search history.

(56) References Cited

U.S. PATENT DOCUMENTS 6,679,480 B1 * 1/2004 Hara ..... F16G 11/02 256/37
6,733,203 B2 * 5/2004 Carlsen ..... F16G 11/048 403/409.1
7,581,909 B2 * 9/2009 Szoke ..... E04F 11/1812 411/401
8,051,615 B2 * 11/2011 Mathews ..... F16G 11/106 52/223.13
8,215,886 B2 * 7/2012 Campbell ..... F16G 11/05 411/401
10,132,347 B2 * 11/2018 Armiento ..... F16B 25/0031
10,461,514 B2 * 10/2019 Crompton ..... F16G 11/025
10,794,063 B1 * 10/2020 Martin ..... E04F 11/1859
2006/0074419 A1 * 4/2006 Taylor ..... A61B 17/808 606/301
2011/0084180 A1 * 4/2011 Toimil ..... F16G 11/106 248/74.2
2015/0204103 A1 * 7/2015 Ostervig ..... E04H 17/24 256/65.15
2015/0204104 A1 * 7/2015 Ostervig ..... E04F 11/1817 256/65.15
2016/0326768 A1 * 11/2016 Schlatter ..... E04F 11/1859
2019/0352926 A1 * 11/2019 Kennedy ..... E04H 17/12
2019/0352928 A1 * 11/2019 Kennedy ..... E04H 17/12
2021/0277663 A1 * 9/2021 Schlatter ..... E04F 11/1859

* cited by examiner

*Primary Examiner* — Joshua T Kennedy
(74) *Attorney, Agent, or Firm* — John J. Elnitski, Jr.

(57) ABSTRACT

A connecting assembly for connecting a cable end of a wire rope to a structure. Each connecting assembly includes a structure attachment interface and cable end attachment interface. The structure attachment interface is adapted to mount to the structure at a point on the structure without the connecting assembly exiting the structure at any other point on the structure. The cable end attachment interface is adapted to mount the cable end to the connecting assembly.

1 Claim, 21 Drawing Sheets

CABLE SYSTEM FOR ATTACHING CABLES BETWEEN TWO STRUCTURES

This application claims the benefit of and incorporates by reference U.S. Provisional Application No. 62/742,995, filed Oct. 9, 2018 and U.S. patent application Ser. No. 16/596,980 filed Oct. 9, 2019.

BACKGROUND

The present invention generally relates to attachment of a cable between two structures. More specifically, the present invention relates to connection assemblies used to attach a cable end to a structure.

When a cable is attached between two structures, there are two cable ends. Each cable end is attached to one of the two structures. Typically, each cable end is attached to a connecting assembly. The connecting assembly includes a component such as a bolt which enters one side of the structure and exits the other side of the structure to receive a fastener such as a nut to secure the cable end to the structure. Some deck railing designs about a porch or deck included several cables strung between deck posts from top to bottom of the railing system. The cables between posts provide a deterrent to prevent someone from falling off a deck. The cable ends are attached to the deck posts using connecting assemblies. The portion of the described connecting assembly exiting the deck post is not aesthetically pleasing in appearance. What is needed is a cable system with connecting assemblies that provide for attaching the cable ends to the structure without unsightly bolts and nuts on the outside of the structure so that the cable system is aesthetically pleasing when viewed.

It is an object of the present invention to provide a cable system using connecting assemblies that do not exit a structure to receive a fastener.

SUMMARY

A connecting assembly for connecting a cable end of a wire rope to a structure. Each connecting assembly includes a structure attachment interface and cable end attachment interface. The structure attachment interface is adapted to mount to the structure at a point on the structure without the connecting assembly exiting the structure at any other point on the structure. The cable end attachment interface is adapted to mount the cable end to the connecting assembly.

DETAILED DESCRIPTION

Figure 1:
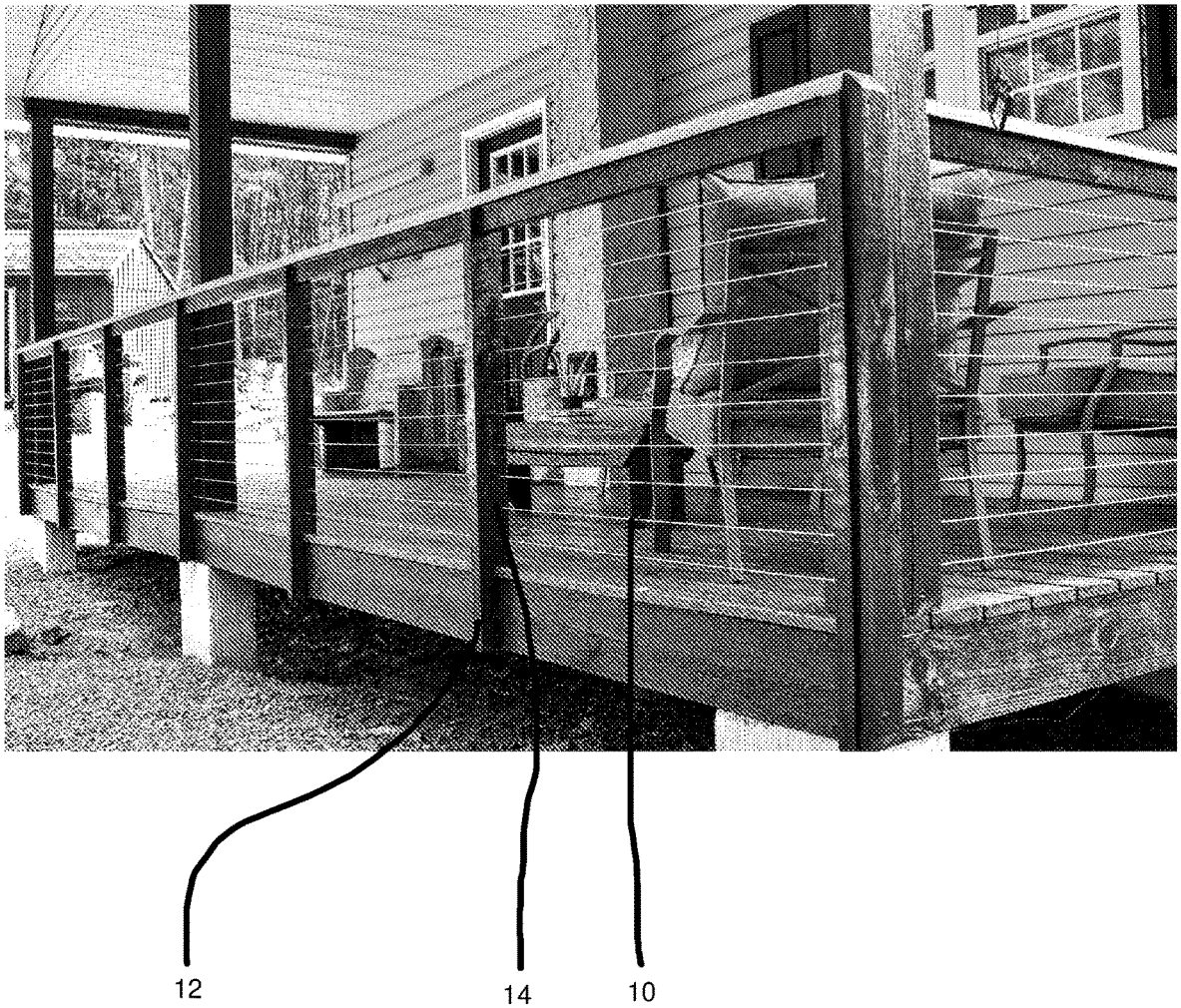
FIG. 1 is a perspective view of a cable system according to the present invention.
Figure 2:
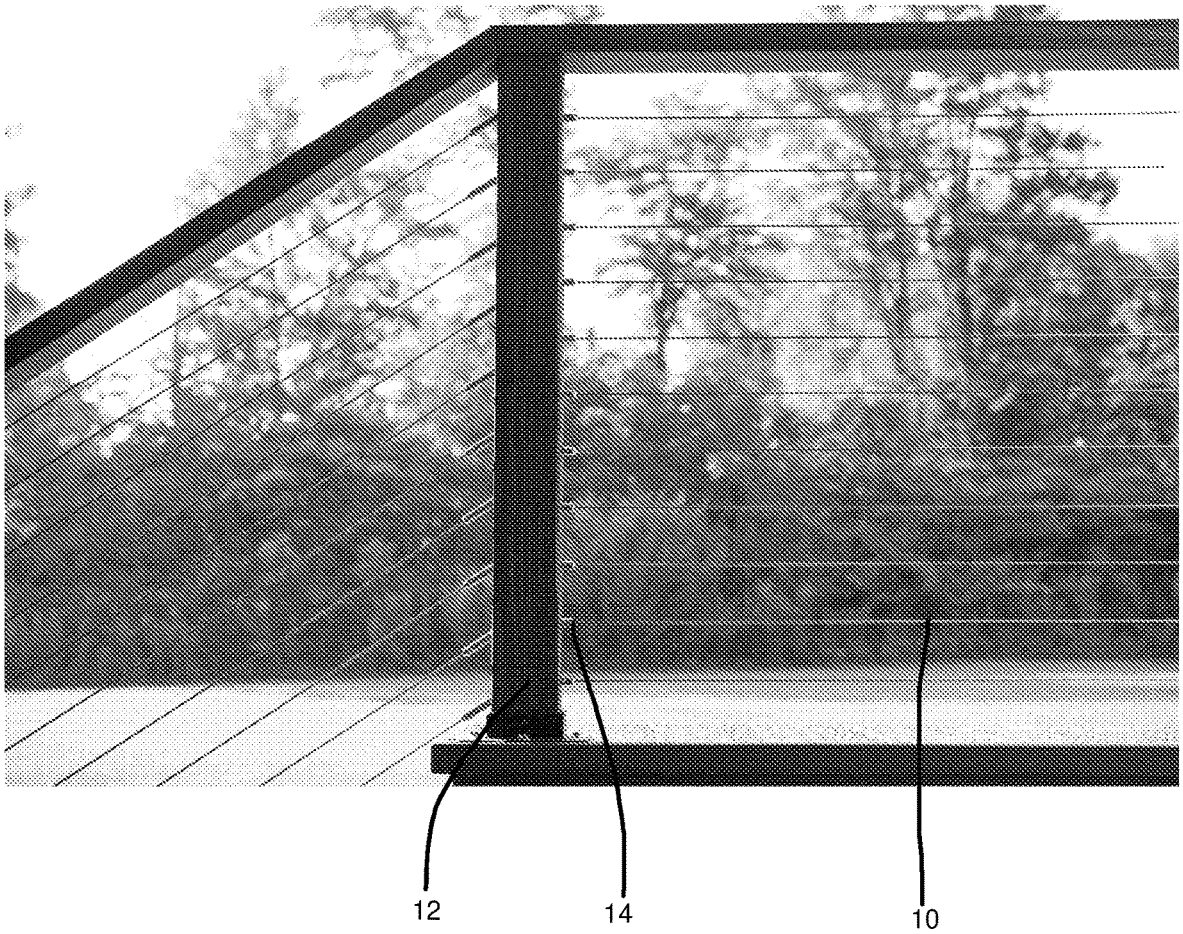
FIG. 2 is a perspective view of a cable system according to the present invention.
Figure 3:
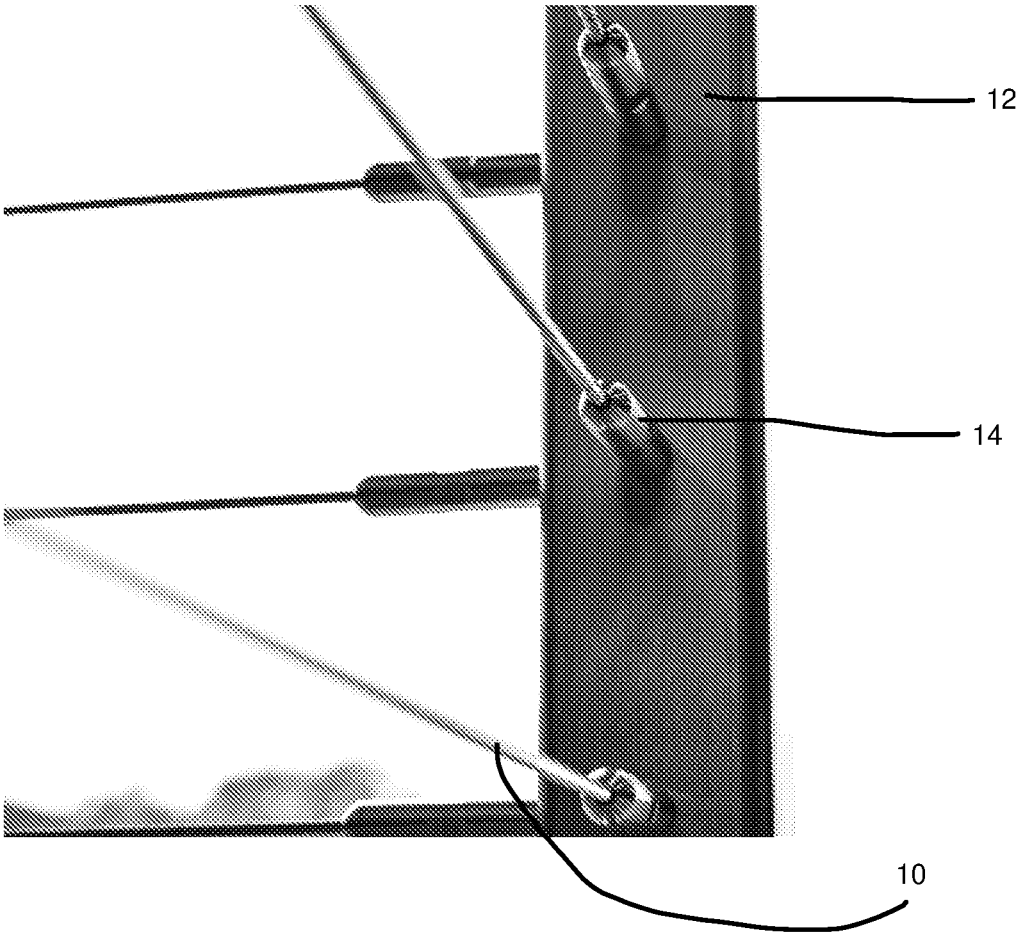
FIG. 3 is a perspective view of a cable system according to the present invention.
Figure 4:
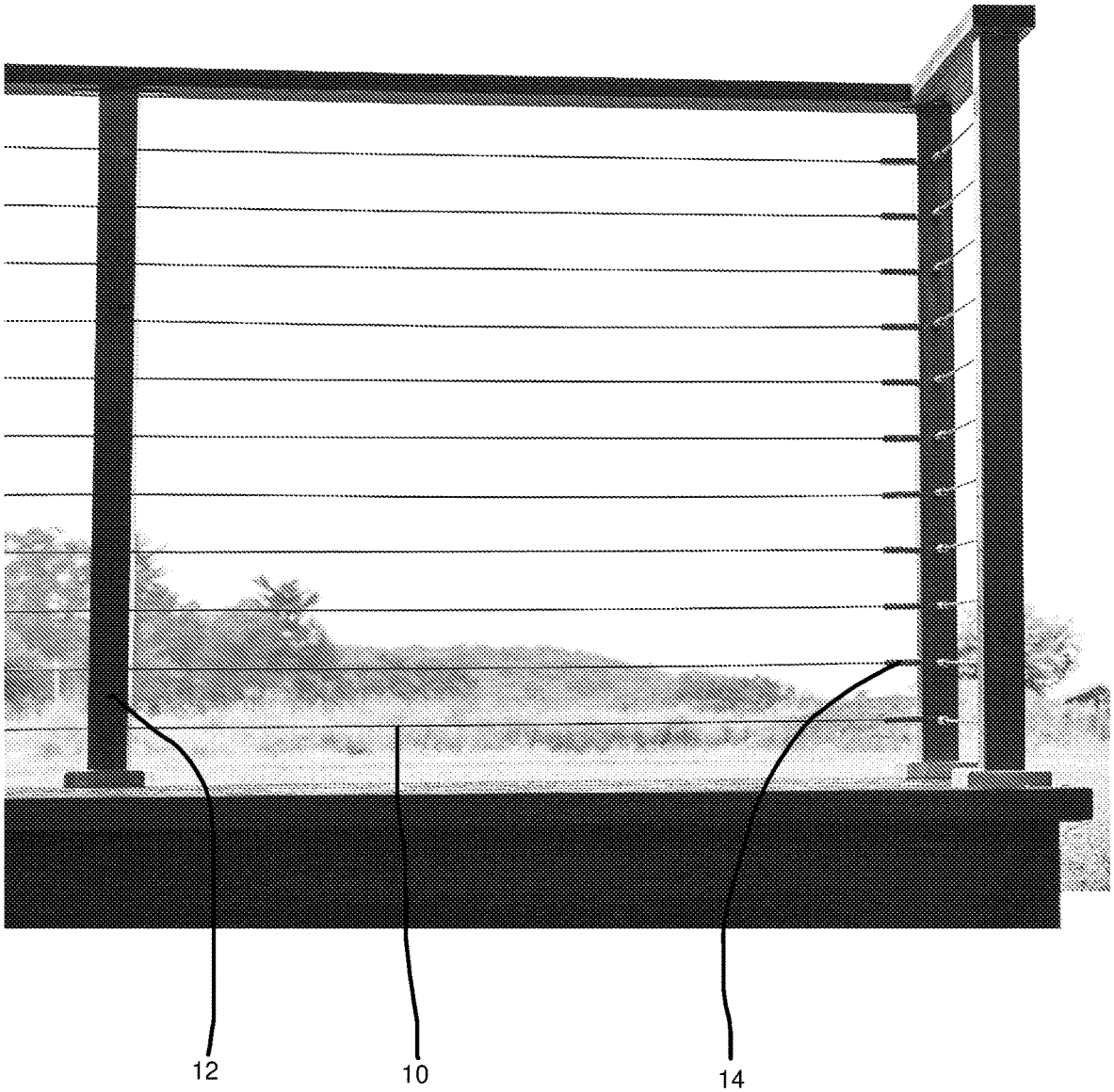
FIG. 4 is a perspective view of a cable system according to the present invention.

The present invention is a cable system to attach cable ends of wire rope to a structure without unsightly parts of the connecting assembly exiting the structure. FIGS. 1-4 show the cable system, where wire ropes 10 are strung between deck posts 12 using connecting assemblies 14. FIGS. 1-4 show the connecting assemblies 14 blindly attached to the deck posts 12, where there is no part of the connecting assemblies 14 exiting the deck post 12 on the opposite side of where the cable end with connecting assembly 14 is attached. The cable system provides different connecting assemblies to receive a cable end. Where the connecting assembly used depends on the type of material of the structure. Cable is also referred to as wire rope. Each connecting assembly includes a structure attachment interface, which are the components that are used to mount the connecting assembly to the structure. Each connecting assembly includes a cable end attachment interface, which are the components that are used to mount the connecting assembly to the cable end of a wire rope.

Figure 5:
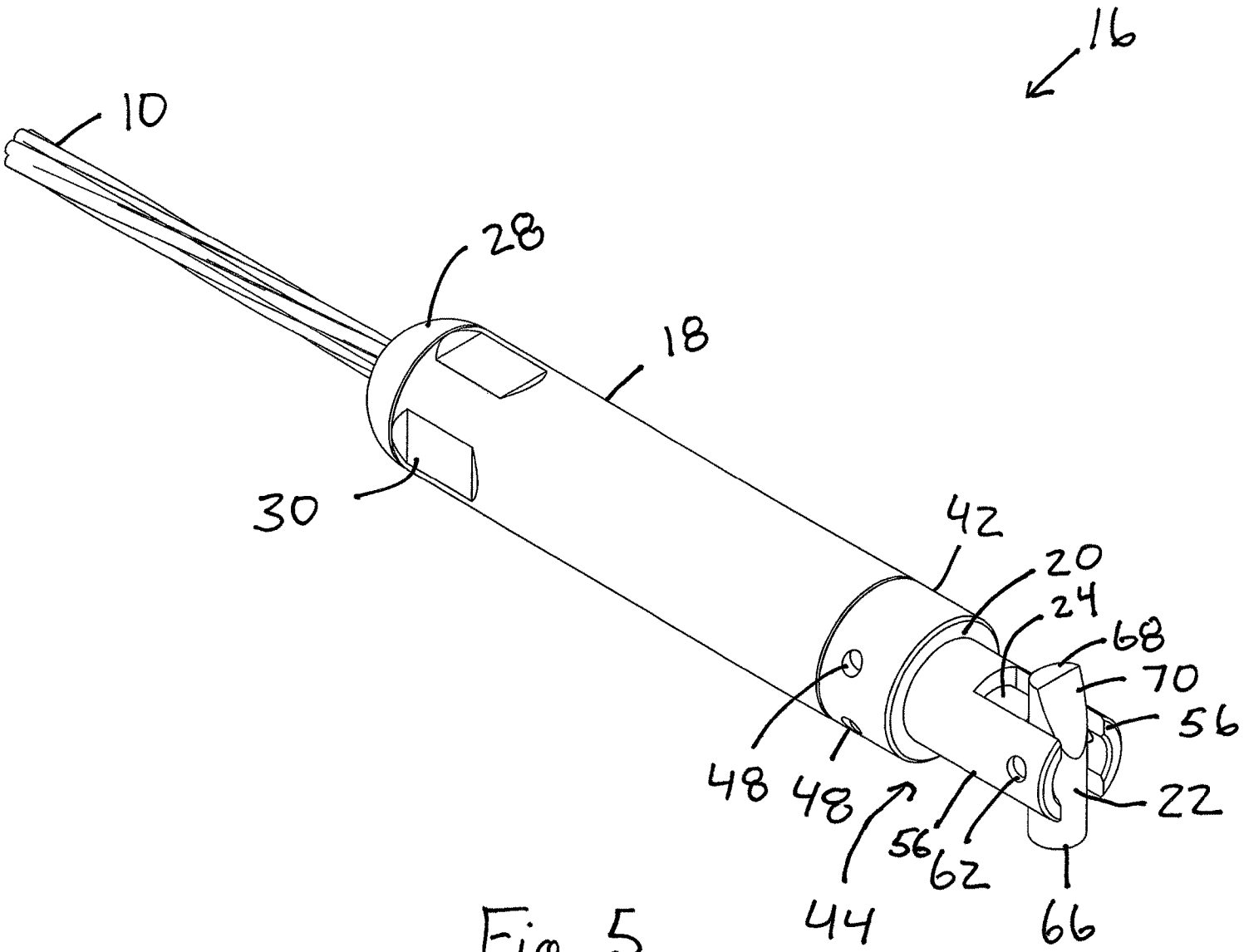
FIG. 5 is a perspective view of a blind swivel connecting assembly according to the present invention.
Figure 6:
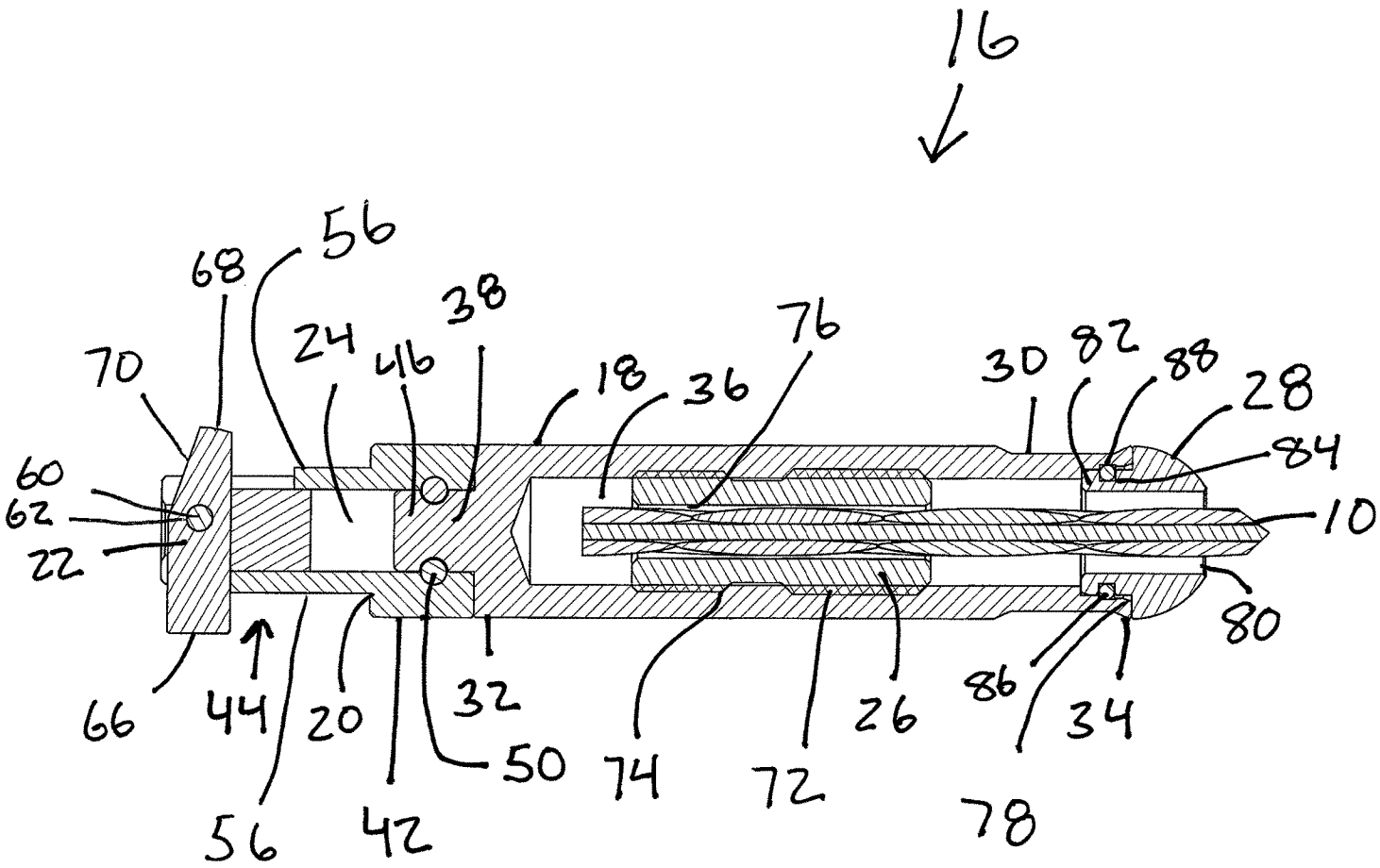
FIG. 6 is a cutaway view of a blind swivel connecting assembly according to the present invention.
Figure 7:
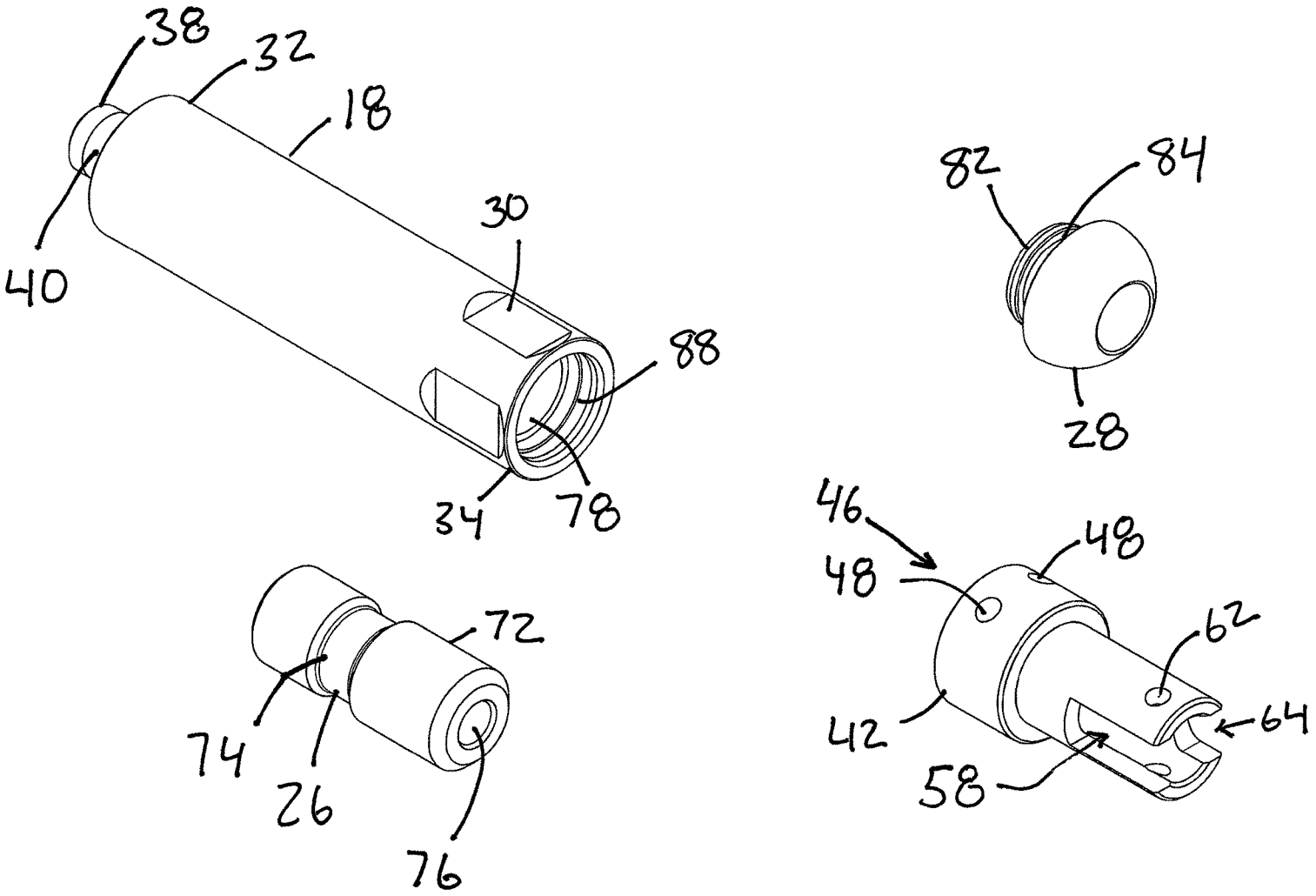
FIG. 7 is an exploded perspective view of a blind swivel connecting assembly according to the present invention.

FIGS. 5-7 show the components of a blind swivel cable connecting assembly 16 that attaches to a structure and receives a wire rope 10. The blind swivel cable connecting assembly 16 allows for adjustment of wire rope length to put tension on the wire rope. The blind swivel cable connecting assembly 16 includes a swivel receiver 18, swivel body 20, toggle 22, rubber plug 24, wire stud 26 and cap 28. The swivel receiver 18 includes wrench slots 30, a swivel body end 32 and a cap end 34. The wrench slots 30 allow for a wrench to engage the swivel receiver 18. The swivel receiver 18 includes a threaded stud channel 36 that is accessible from the cap end 34. The swivel body end 32 includes a retainer stud 38 with a groove 40. The swivel body 20 includes a main body 42 with a toggle retainer 44 extending from the main body 42. The main body 42 includes a stud cavity 46 and two pairs of pin holes 48. Each pair of pin holes 48 are aligned to receive a spring pin 50 that travels through the stud cavity 46. The swivel body 20 is connected to the swivel receiver 18 by inserting the retainer stud 38 into the stud cavity 46 so that the groove 40 aligns with the pin holes 48. The two spring pins 50 are inserted into the pin holes 48 so that the spring pins 50 engage the groove 40. The spring pins 50 retain the swivel body 20 to the swivel receiver 18, while allowing the swivel body 20 to rotate about the retainer stud 38.

The toggle retainer 44 includes two legs 56 that form a toggle slot 58. The toggle 22 is rotatably connected between the legs 56 near end of the toggle slot 58 using a spring pin 60 through pin holes 62 in the legs 56 and toggle 22. The toggle retainer 44 also includes a toggle stop slot 64 between the two legs 56 that is shorter in length than the toggle slot 58. The toggle 22 includes first end 66 that is cylinder shape that rotates into the toggle stop slot 64. The toggle includes a second end 68 of a cylinder shape that rotates into the toggle slot 58 with material removed to form a slanted surface 70. The toggle 22 is of a length such that when the toggle 22 is rotated into the toggle slot 58 and the toggle stop slot 64, the toggle 22 extends outward from the toggle slot 58 and the toggle stop slot 64. The rubber plug 24 is installed in the toggle retainer 44. The location of the rubber plug 24 is between the legs 56 in the area of the toggle slot 58. The rubber plug 24 is flexible such that pressure against a surface of the rubber plug 24 at a point of contact allows deformation of the rubber plug 24 at the point of contact.

The wire stud 26 includes a threaded end 72, a crimpable end 74 and a wire channel 76. The wire channel 76 is for receiving wire rope 10 by inserting the wire rope 10 into the threaded end 72 of the wire channel 76 until there is wire rope 10 in the wire channel 76 in the area of the crimpable end 74. Once there is wire rope 10 in the crimpable end 74, the crimpable end 74 can be crimped to retain the wire rope 10 to the wire stud 26. The wire stud 26 threads into the stud channel 36 of the swivel receiver 18, where the crimpable end 74 is first inserted into an opening 78 in cap end 34. The cap 28 includes a wire hole 80 and an insert end 82, the insert end 82 includes a groove 84 and an O-ring 86 in the groove 84. The opening 78 of the cap end 34 of the swivel receiver 18 includes an O-ring cutout 88 to receive the insert end 82 of the cap 28, where the O-ring 86 retains the cap 28 in place once inserted in the cap end 34. The wire hole 80 is for allowing wire rope 10 to pass through the cap 28.

The blind swivel cable connecting assembly of FIGS. 5-7 is install by drilling a hole in the structure in an area that is hollow so when the toggle 22 is activated, the ends 66, 68 of the toggle 22 engage the inside surface of the structure. The cap 28 is installed onto the wire rope 10 before the wire rope 10 is installed in the wire stud 26. The wire rope 10 is inserted into the wire stud 26 and crimped. The wire stud 26 is installed by threading the swivel receiver 18 onto the wire stud 26. Then, the cap 28 is forced into the cap end 34 of the swivel receiver 18 so that the O-ring 86 holds the cap 28 in place. The toggle 10 is installed in the structure by forcing the second end 68 of the toggle into the toggle slot 58 and against the rubber plug 24. The toggle 22 is held in that position so that the toggle 22 with the legs 56 of the toggle retainer 44 will clear the hole in the structure. The slanted surface 70 allows for additional clearance as the toggle retainer 44 is inserted into the hole. After the legs 56 of the toggle retainer 44 are inserted into the hole, the toggle 22 springs outward due to the rubber plug 24 rebounding to its original shape when the toggle 22 is no longer being held in place, where the rubber plug 24 acts as a spring. The ends 66, 68 of the toggle 22 will then engage the inside surface of the structure. The length of the wire rope 10 in the swivel receiver 18 can then be adjusted by turning the swivel receiver 18 about the wire stud 26 and the wire rope 10, where the wire stud 26 will move in either direction based on the direction of turning the swivel receiver 18. The adjustment of the length of the wire rope 10 is usually done after the other end of the wire rope 10 is attached to a structure using a fixed connecting assembly.

Figure 8:
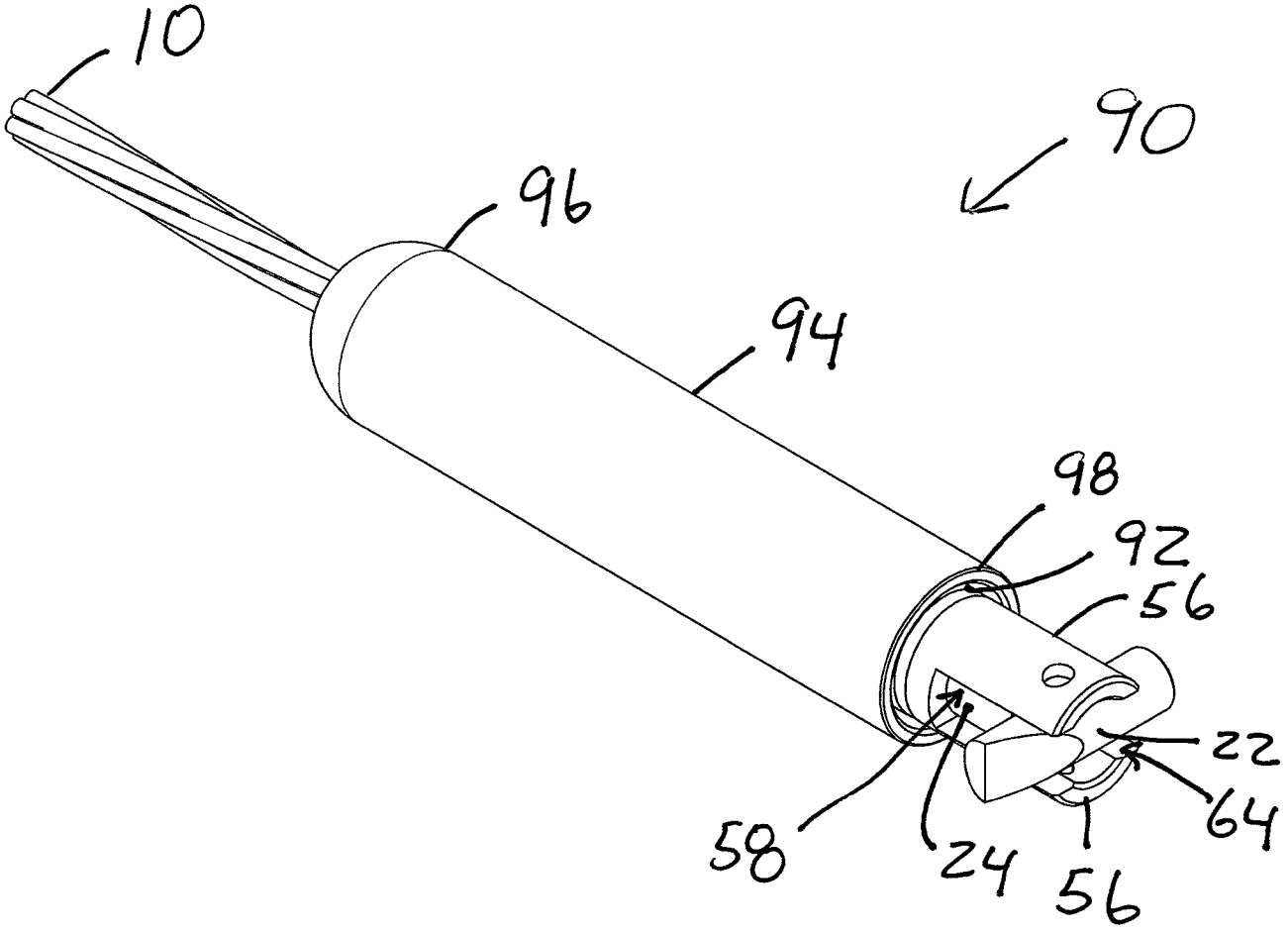
FIG. 8 is a perspective view of a blind solid cable connecting assembly according to the present invention.
Figure 9:
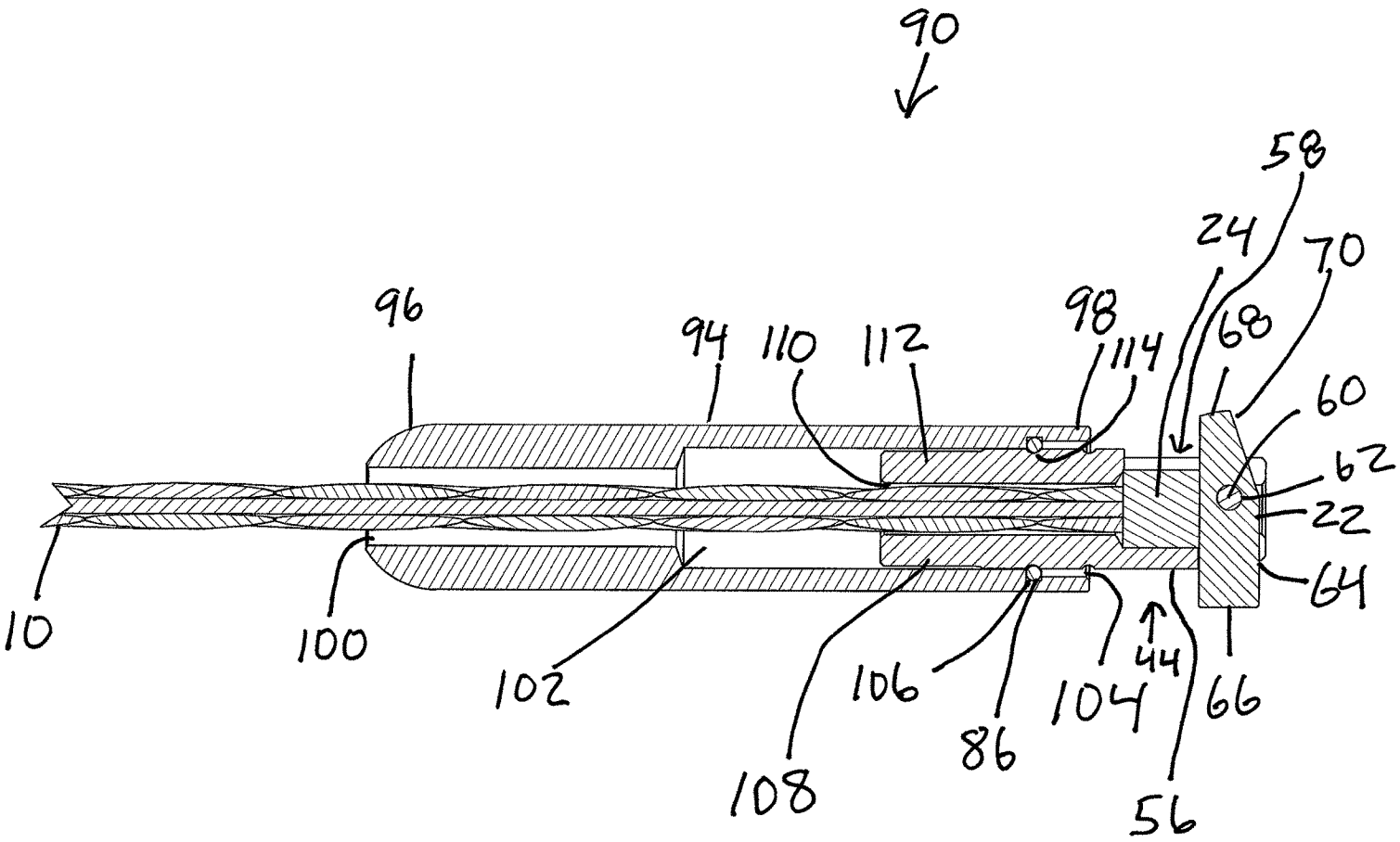
FIG. 9 is a cutaway view of a blind solid cable connecting assembly according to the present invention.
Figure 10:
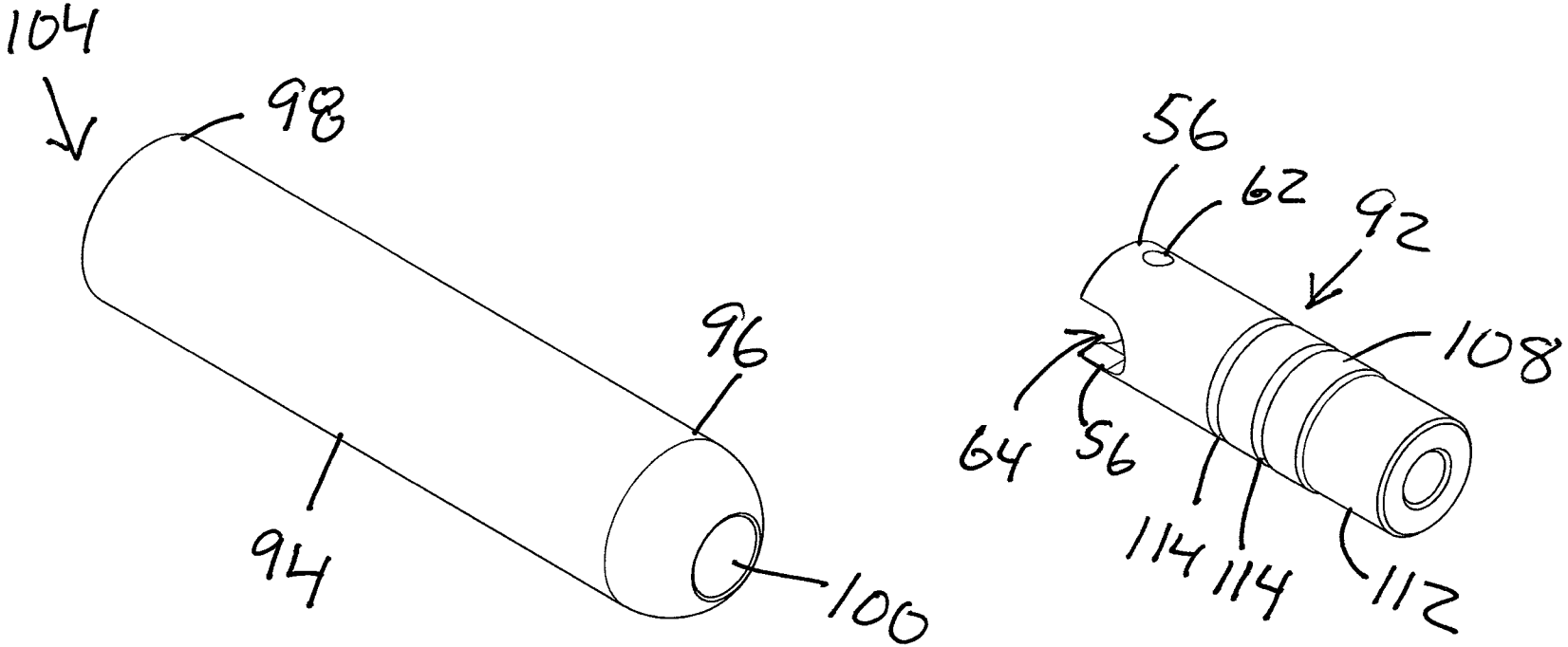
FIG. 10 is an exploded perspective view of a blind solid cable connecting assembly according to the present invention.

FIGS. 8-10 show the components of a blind solid cable connecting assembly 90 that attaches to a structure and receives a wire rope 10. The blind solid cable connecting assembly 90 is a fixed assembly that does not allow for adjustment of wire rope length once the wire rope 10 is attached to the blind solid cable connecting assembly 90. The blind solid cable connecting assembly 90 includes a toggle body 92, cover 94, toggle 22, and rubber plug 24. The cover 94 includes wrench slots 30, a cap end 96 and a toggle body end 98. The cover 94 includes wire hole 100 in the cap end 96 and a toggle body channel 102 that is accessible using an opening 104 in the toggle body end 98. The toggle body end 98 includes an O-ring groove 106 and O-ring 86. The toggle body 92 includes a main body 108 with a toggle retainer 44 extending from the main body 108. The main body 108 includes a wire rope channel 110, a crimpable end 112 and O-ring grooves 114.

The toggle retainer 44 includes two legs 56 that form a toggle slot 58. The toggle 22 is rotatably connected between the legs 56 near end of the toggle slot 58 using a spring pin 60 through pin holes 62 in the legs 56 and toggle 22. The toggle retainer 44 also includes a toggle stop slot 64 between the two legs 56 that is shorter in length than the toggle slot 58. The toggle 22 includes first end 66 that is cylinder shape that rotates into the toggle stop slot 64. The toggle includes a second end 68 of a cylinder shape that rotates into the toggle slot 58 with material removed to form a slanted surface 70. The toggle 22 is of a length such that when the toggle 22 is rotated into the toggle slot 58 and the toggle stop slot 64, the toggle 22 extends outward from the toggle slot 58 and the toggle stop slot 64. The rubber plug 24 is installed in the toggle retainer 44. The location of the rubber plug 24 is between the legs 56 in the area of the toggle slot 58. The rubber plug 24 is flexible such that pressure against a surface of the rubber plug 24 at a point of contact allows deformation of the rubber plug 24 at the point of contact.

The blind solid cable connecting assembly of FIGS. 8-10 is installed by first inserting the wire rope 10 in wire hole 100 of the cap end 96 and through the cover 94. Next the wire rope 10 is crimped in the main body 108 of the toggle body 92. The toggle 22 is installed in the structure by forcing the second end 68 of the toggle into the toggle slot 58 and against the rubber plug 24. The toggle 22 is held in that position so that the toggle 22 with the legs 56 of the toggle retainer 44 will clear the hole in the structure. The slanted surface 70 allows for additional clearance as the toggle retainer 44 is inserted into the hole. After the legs 56 of the toggle retainer 44 are inserted into the hole, the toggle 22 springs outward due to the rubber plug 24 rebounding to its original shape when the toggle 22 is no longer being held in place, where the rubber plug 24 acts as a spring. The ends 66, 68 of the toggle 22 will then engage the inside surface of the structure. Finally, the cover is forced over the main body, so that the O-ring engages one of the O-ring grooves on the main body.

Figure 11:
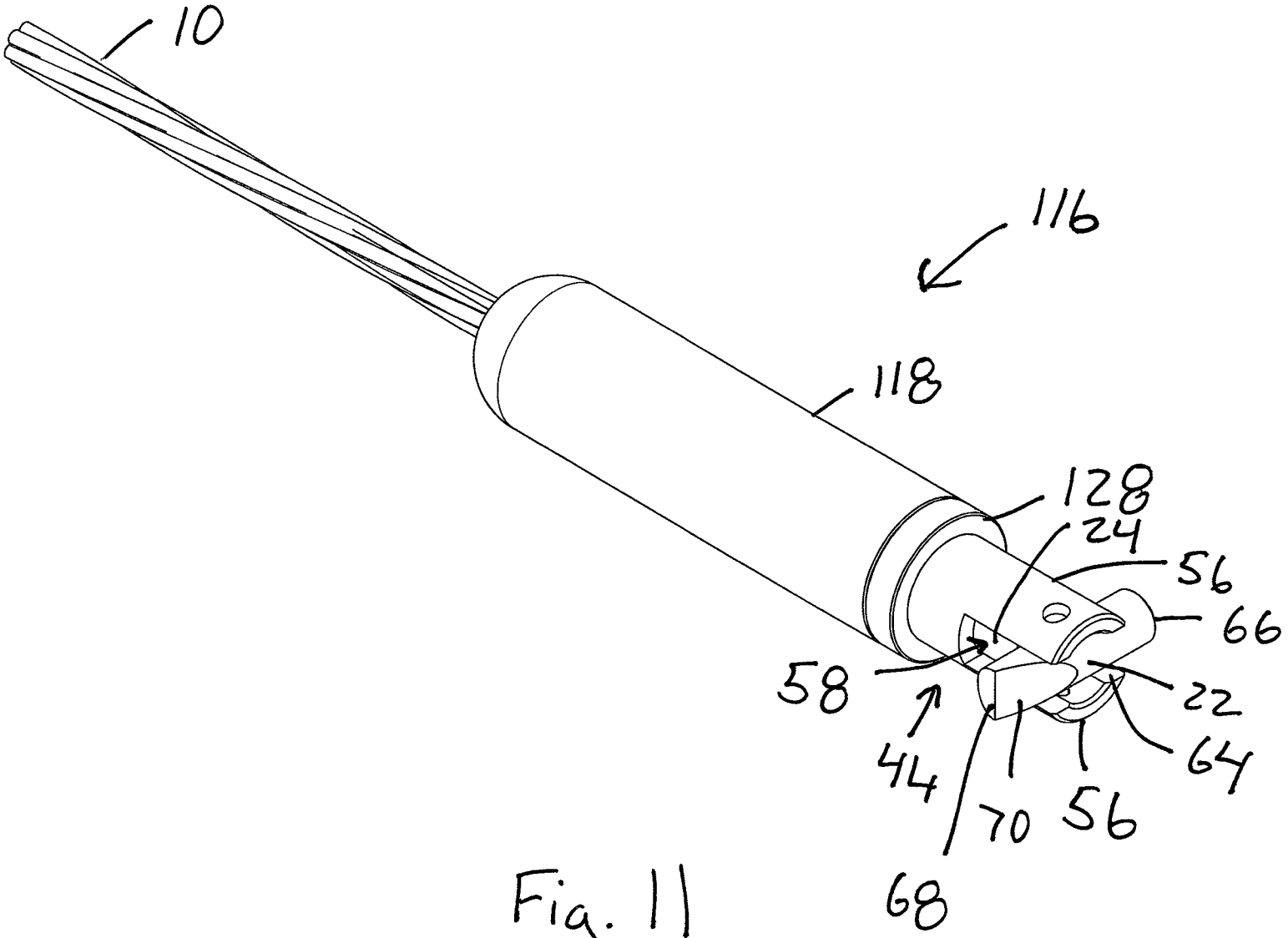
FIG. 11 is a perspective view of a blind solid cable connecting assembly according to the present invention.
Figure 12:
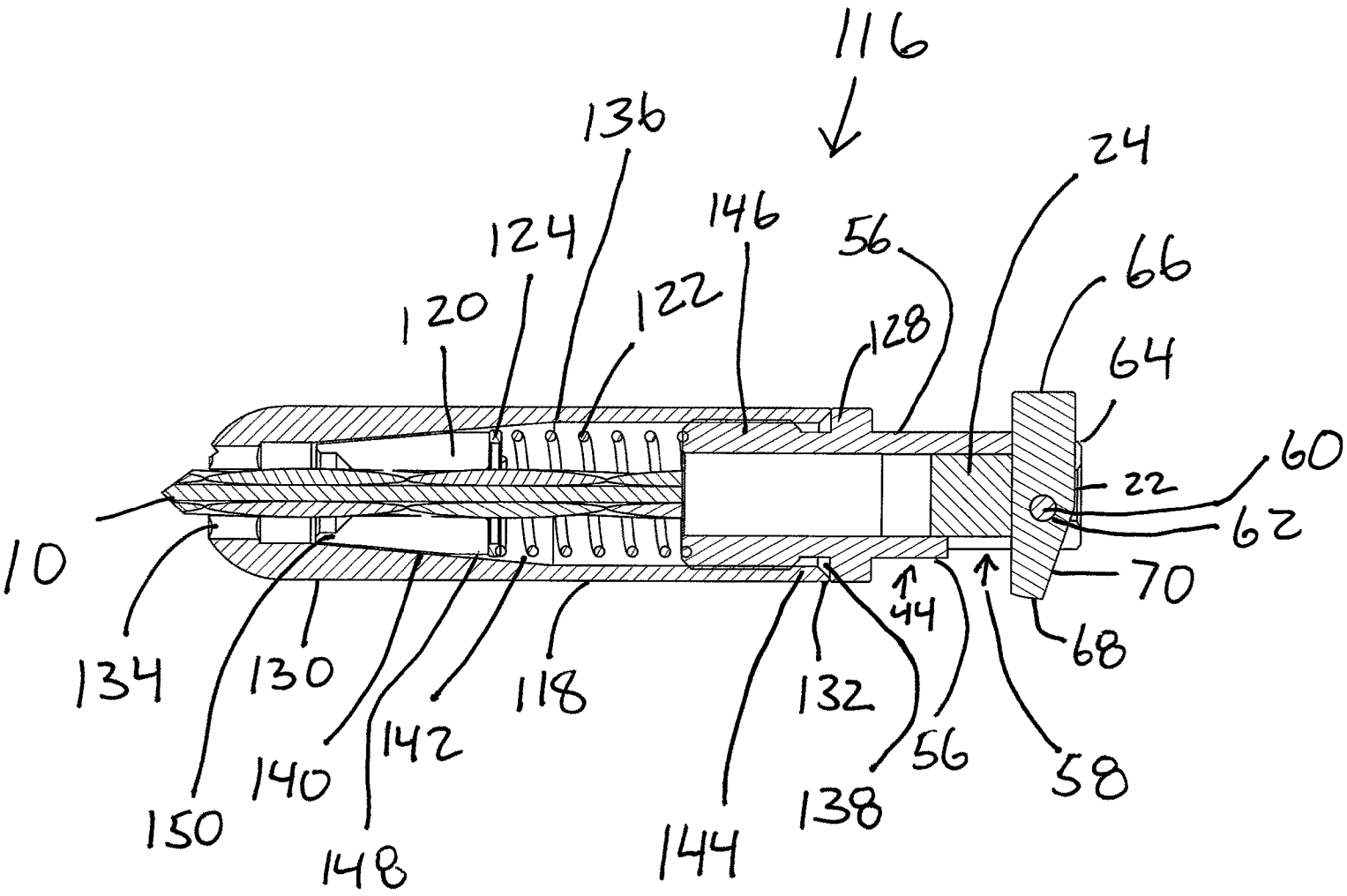
FIG. 12 is a cutaway view of a blind solid cable connecting assembly according to the present invention.
Figure 13:
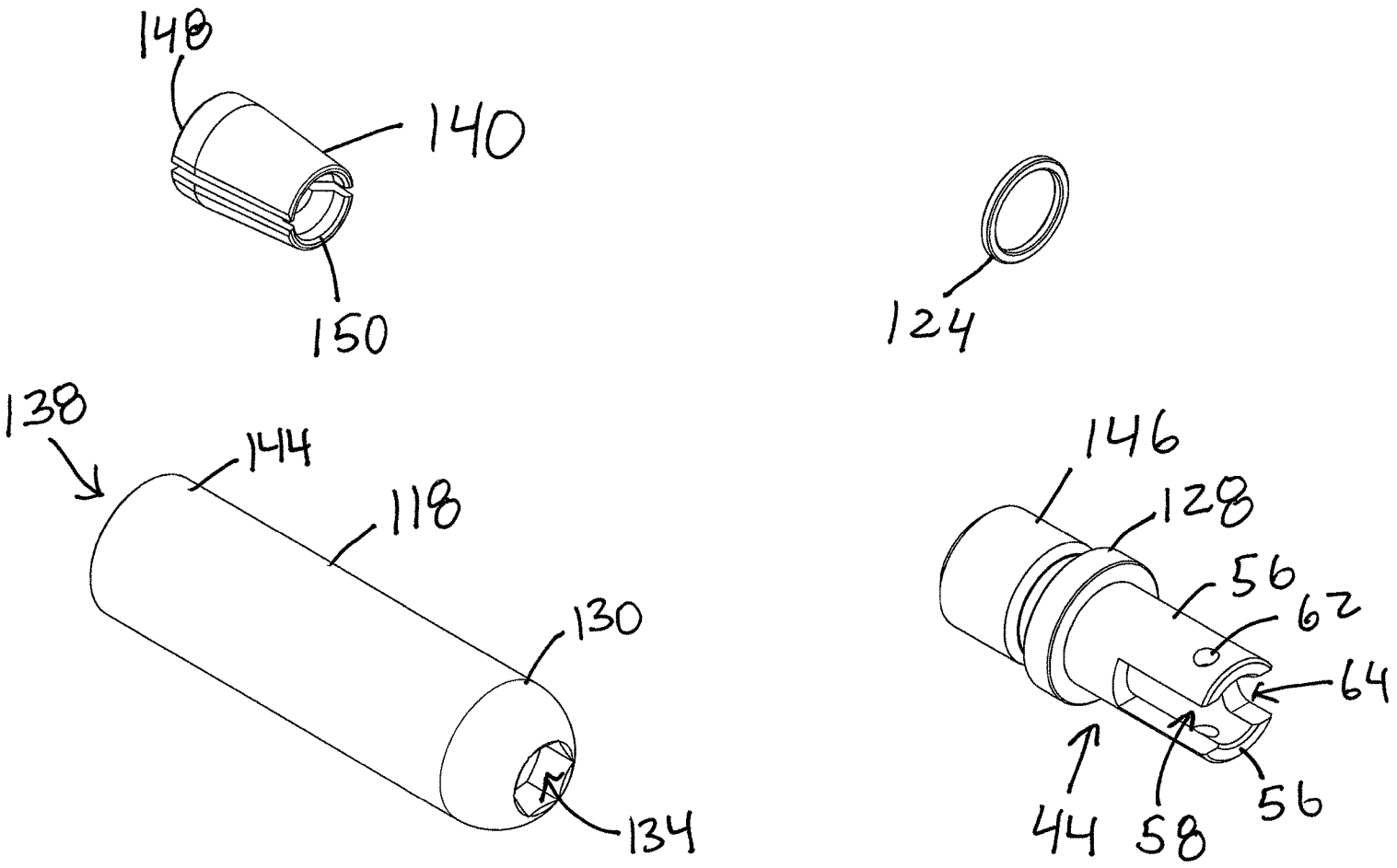
FIG. 13 is an exploded perspective view of a blind solid cable connecting assembly according to the present invention.

FIGS. 11-13 show the components of a blind solid cable connecting assembly 116 that attaches to a structure and receives a wire rope 10. The blind solid cable connecting assembly 116 is a fixed assembly that does not allow for adjustment of wire rope length once the wire rope 10 is attached to the blind solid cable connecting assembly 116. The blind solid cable connecting assembly 116 includes a feature of self gripping of the wire rope 10. The blind solid cable connecting assembly 116 includes a gripping body 118, a wedge 120, a wedge spring 122, grip washer 124, toggle body 128, toggle 22, and rubber plug 24. The gripping body 118 includes a cap end 130 and a toggle body end 132. The gripping body 118 includes wire hole 134 in the cap end 130 to receive a wire rope 10 and a toggle body channel 136 that is accessible using an opening 138 in the toggle body end 132. The toggle body channel 136 includes a wedge section 140, spring section 142 and threaded section 144. The wedge section 140 is near the cap end 130 and increases in width (diameter) from the cap end 130 towards the toggle body end 132. The spring section 142 receives the grip washer 124 and wedge spring 122 from the opening 138 in the toggle body end 132. The toggle body 128 includes a threaded end 146 and a toggle retainer 44 extending from the threaded end 146. The wedge 120 is shown as a two piece wedge that reduces in width (diameter) from top 148 to bottom 150 of the wedge 120. The threaded end 146 of the toggle body 128 threads into the threaded section 144 of the gripping body 118. The threaded end 146 will engage the wedge spring 122 as the threaded end 146 moves into the gripping body 118 to put tension on the wedge spring 122.

The toggle retainer 44 includes two legs 56 that form a toggle slot 58. The toggle 22 is rotatably connected between the legs 56 near end of the toggle slot 58 using a spring pin 60 through pin holes 62 in the legs 56 and toggle 22. The toggle retainer 44 also includes a toggle stop slot 64 between the two legs 56 that is shorter in length than the toggle slot 58. The toggle 22 includes first end 66 that is cylinder shape that rotates into the toggle stop slot 64. The toggle includes a second end 68 of a cylinder shape that rotates into the toggle slot 58 with material removed to form a slanted surface 70. The toggle 22 is of a length such that when the toggle 22 is rotated into the toggle slot 58 and the toggle stop slot 64, the toggle 22 extends outward from the toggle slot 58 and the toggle stop slot 64. The rubber plug 24 is installed in the toggle retainer 44. The location of the rubber plug 24 is between the legs 56 in the area of the toggle slot 58. The rubber plug 24 is flexible such that pressure against a surface of the rubber plug 24 at a point of contact allows deformation of the rubber plug 24 at the point of contact.

The blind solid cable connecting assembly of FIGS. 11-13 is installed by starting with an assembled assembly of the toggle body 128 and gripping body 118 with the wedge 120, wedge spring 122 and grip washer 124. The toggle 22 is installed in the structure by forcing the second end 68 of the toggle into the toggle slot 58 and against the rubber plug 24. The toggle 22 is held in that position so that the toggle 22 with the legs 56 of the toggle retainer 44 will clear the hole in the structure. The slanted surface 70 allows for additional clearance as the toggle retainer 44 is inserted into the hole. After the legs 56 of the toggle retainer 44 are inserted into the hole, the toggle 22 springs outward due to the rubber plug 24 rebounding to its original shape when the toggle 22 is no longer being held in place, where the rubber plug 24 acts as a spring. The ends 66, 68 of the toggle 22 will then engage the inside surface of the structure. The wire rope 10 is then inserted into the wire hole 134 and pushed past the wedge 120. Once the wire rope 10 is pushed past the wedge 120, the wire rope 10 is pulled away from the cap end 130 to engage the self gripping action of the wedge 120 to lock the wire rope 10 in place.

Figure 14:
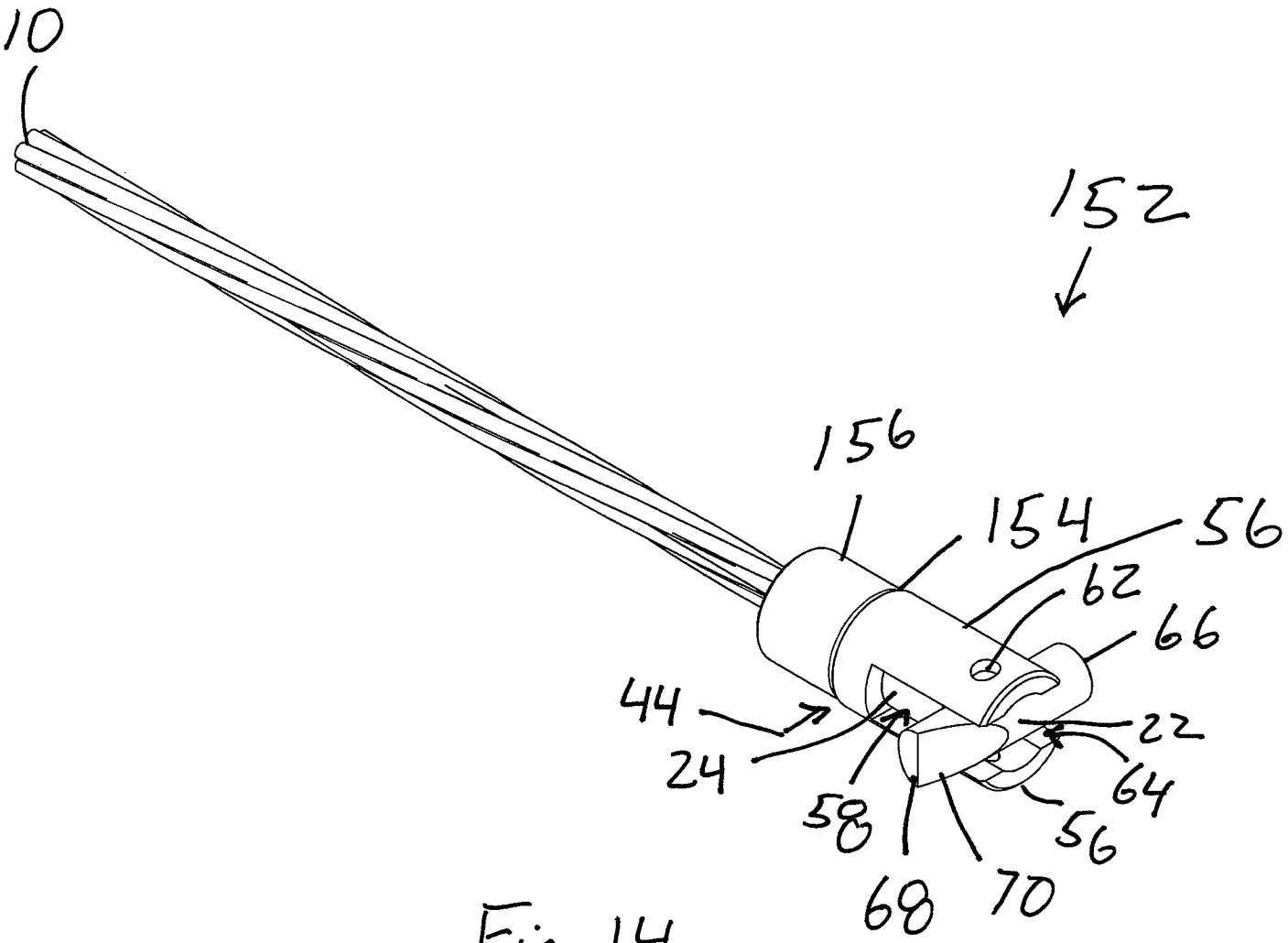
FIG. 14 is a perspective view of a blind solid cable connecting assembly according to the present invention.
Figure 15:
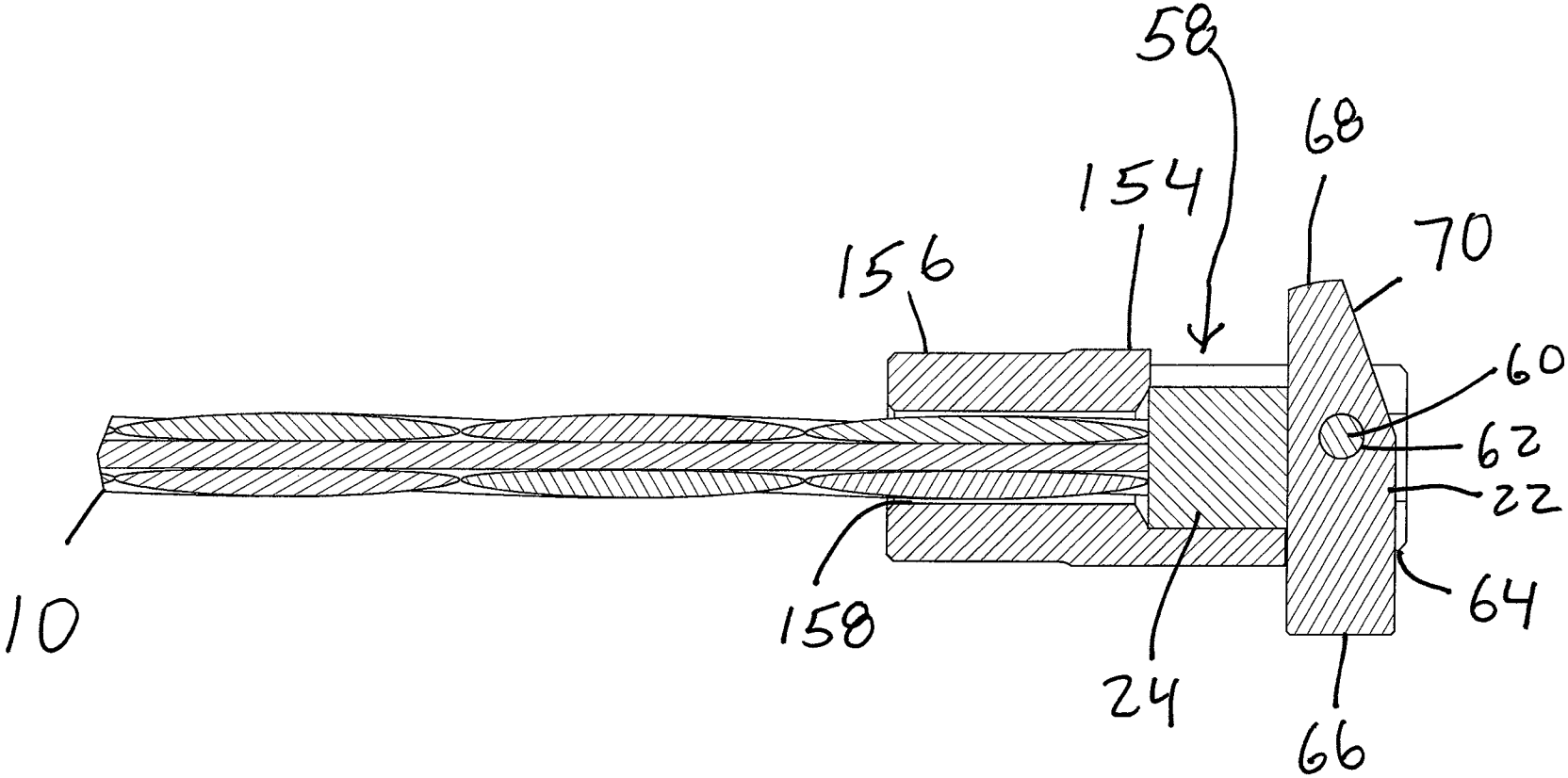
FIG. 15 is a cutaway view of a blind solid cable connecting assembly according to the present invention.

FIGS. 14-15 show the components of a blind solid cable connecting assembly 152 that attaches to a structure and receives a wire rope 10. The blind solid cable connecting assembly 152 is a fixed assembly that does not allow for adjustment of wire rope length once the wire rope 10 is attached to the blind solid cable connecting assembly 152. The blind solid cable connecting assembly 152 includes a main body 154, toggle 22, and rubber plug 24. The main body 154 includes a crimpable section 156 and a toggle retainer 44. The crimpable section 156 includes a wire channel 158 to receive an end of a wire rope 10. The crimpable section 156 can be crimped with the wire rope 10 installed to retain the main body 154 to the wire rope 10.

The toggle retainer 44 includes two legs 56 that form a toggle slot 58. The toggle 22 is rotatably connected between the legs 56 near end of the toggle slot 58 using a spring pin 60 through pin holes 62 in the legs 56 and toggle 22. The toggle retainer 44 also includes a toggle stop slot 64 between the two legs 56 that is shorter in length than the toggle slot 58. The toggle 22 includes first end 66 that is cylinder shape that rotates into the toggle stop slot 64. The toggle includes a second end 68 of a cylinder shape that rotates into the toggle slot 58 with material removed to form a slanted surface 70. The toggle 22 is of a length such that when the toggle 22 is rotated into the toggle slot 58 and the toggle stop slot 64, the toggle 22 extends outward from the toggle slot 58 and the toggle stop slot 64. The rubber plug 24 is installed in the toggle retainer 44. The location of the rubber plug 24 is between the legs 56 in the area of the toggle slot 58. The rubber plug 24 is flexible such that pressure against a surface of the rubber plug 24 at a point of contact allows deformation of the rubber plug 24 at the point of contact.

The blind solid cable connecting assembly of FIGS. 14-15 is installed by inserting the wire rope 10 in the wire channel 158 of the crimpable section 156 of the main body 154. The crimpable section 156 is crimped to retain the wire rope 10. The toggle 22 is installed in the structure by forcing the second end 68 of the toggle into the toggle slot 58 and against the rubber plug 24. The toggle 22 is held in that position so that the toggle 22 with the legs 56 of the toggle retainer 44 will clear the hole in the structure. The slanted surface 70 allows for additional clearance as the toggle retainer 44 is inserted into the hole. After the legs 56 of the toggle retainer 44 are inserted into the hole, the toggle 22 springs outward due to the rubber plug 24 rebounding to its original shape when the toggle 22 is no longer being held in place, where the rubber plug 24 acts as a spring. The ends 66, 68 of the toggle 22 will then engage the inside surface of the structure.

Figure 16:
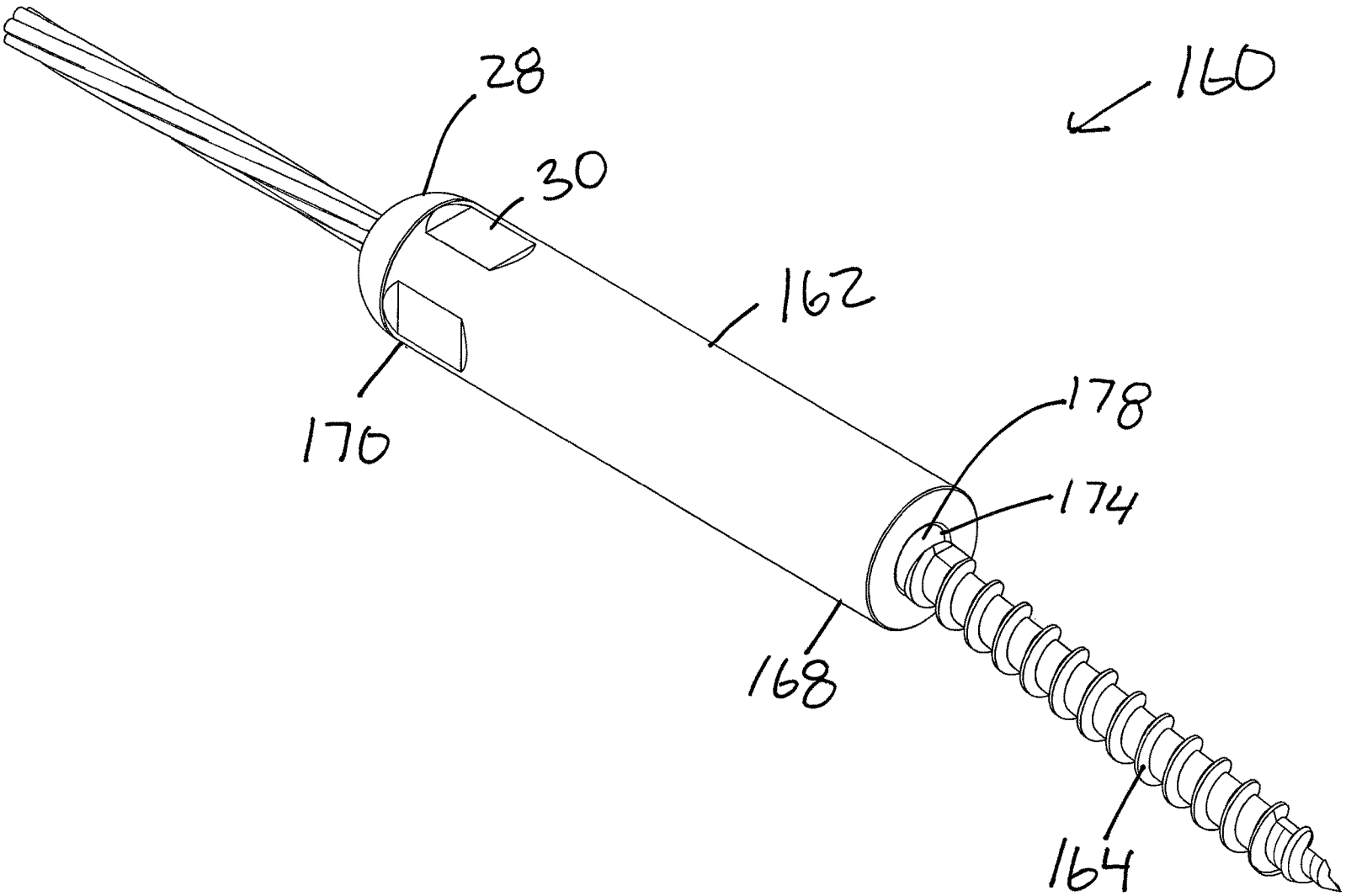
FIG. 16 is a perspective view of a screw swivel cable connecting assembly according to the present invention.
Figure 17:
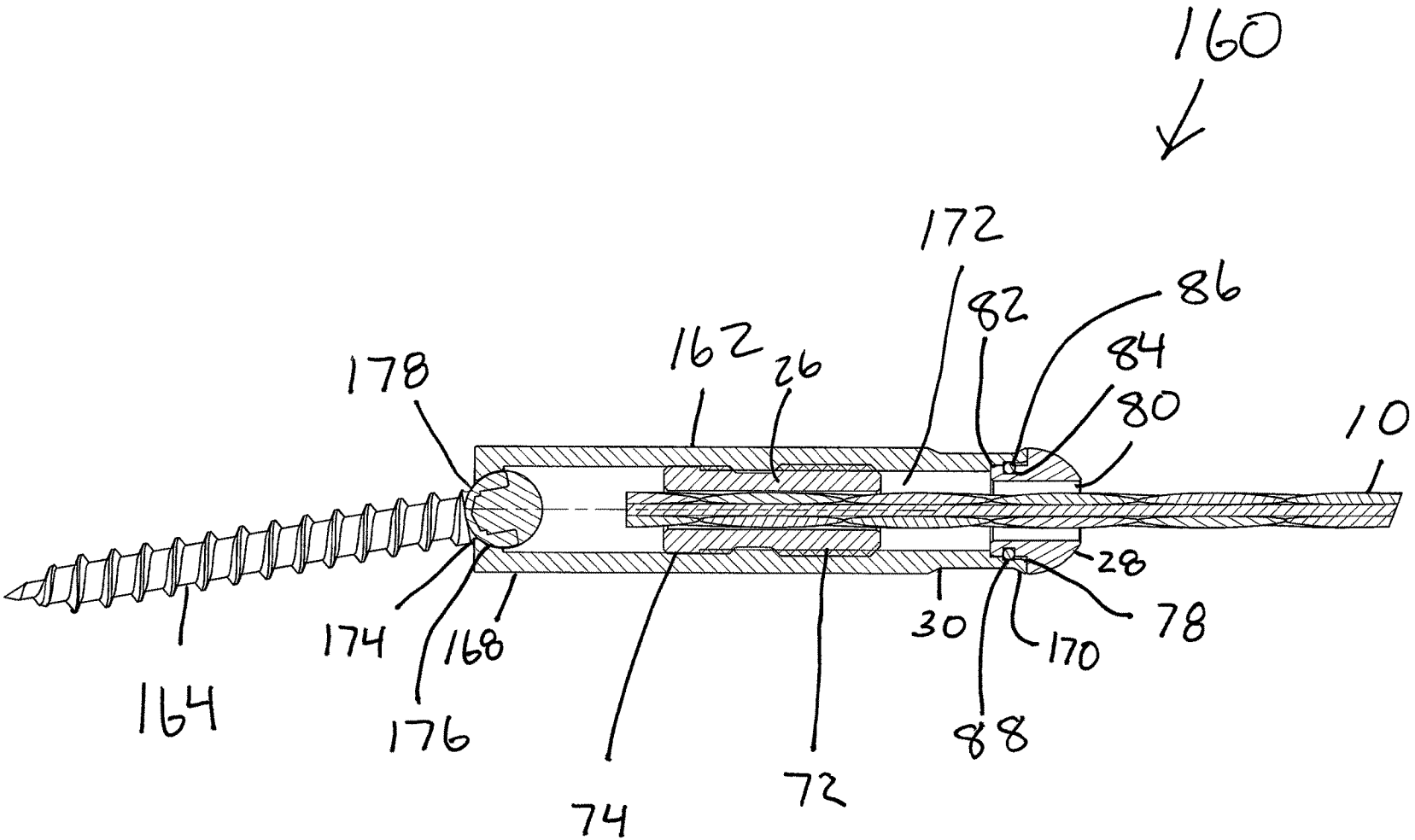
FIG. 17 is a cutaway view of a screw swivel cable connecting assembly according to the present invention.
Figure 18:
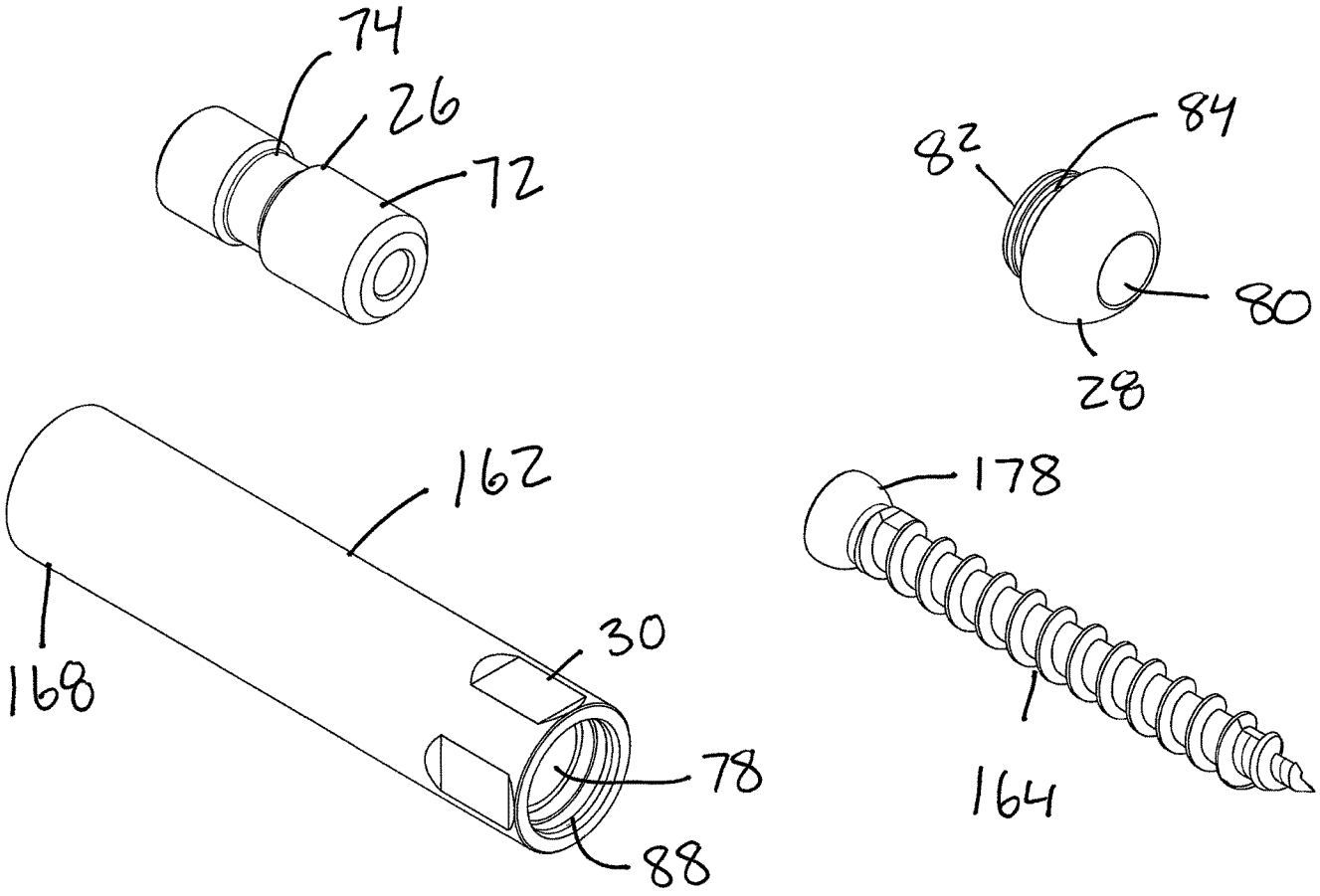
FIG. 18 is an exploded perspective view of a screw swivel cable connecting assembly according to the present invention.

FIGS. 16-18 show the components of a screw swivel cable connecting assembly 160 that attaches to a structure and receives a wire rope 10. The screw swivel cable connecting assembly 160 allows for adjustment of wire rope length. The screw swivel cable connecting assembly 160 includes a swivel receiver 162, screw 164, wire stud 26 and cap 28. The swivel receiver 162 includes wrench slots 30, a swivel body end 168 and a cap end 170. The wrench slots 30 allow for a wrench or socket to engage the swivel receiver 162. The swivel receiver 162 includes a threaded stud channel 172 that is accessible from the cap end 170. The swivel body end 168 includes a screw hole 174 to allow the screw 164 to extend from the swivel body end 168. The screw hole 174 includes a rounded surface 176 about the screw hole 174 inside the swivel body end 168. The screw 164 includes a rounded head 178 that engages the rounded surface 176 to allow movement of the screw head 178 in the swivel receiver 162.

The wire stud 26 includes a threaded end 72, a crimpable end 74 and a wire channel 76. The wire channel 76 is for receiving wire rope 10 by inserting the wire rope 10 into the threaded end 72 of the wire channel 76 until there is wire rope 10 in the wire channel 76 in the area of the crimpable end 74. Once there is wire rope 10 in the crimpable end 74, the crimpable end 74 can be crimped to retain the wire rope 10 to the wire stud 26. The wire stud 26 threads into the stud channel 172 of the swivel receiver 162, where the crimpable end 74 is first inserted into an opening 78 in cap end 170. The cap 28 includes a wire hole 80 and an insert end 82, the insert end 82 includes a groove 84 and an O-ring 86 in the groove 84. The opening 78 of the cap end 170 of the swivel receiver 162 includes an O-ring cutout 88 to receive the insert end 82 of the cap 28, where the O-ring 86 retains the cap 28 in place once inserted in the cap end 170. The wire hole 80 is for allowing wire rope 10 to pass through the cap 28.

The screw swivel cable connecting assembly of FIGS. 16-18 is installed by inserting the screw 164 into the threaded stud channel 172 from the cap end 170 so that the screw 164 extends from the screw hole 174 of the swivel body end 168. The screw 174 is shown with a torx head that is screwed into the structure using a long torx bit to secure the swivel receiver 162 to the structure. The rounded shape of the screw head 178 and the surface 176 about the screw hole 174 inside the swivel body end 168 allows the swivel receiver 162 to rotate about the screw head 178 for cable position adjustment. The rounded shape of the screw head 178 and the surface 176 about the screw hole 174 inside the swivel body end 168 allows the swivel receiver 162 to be positioned on an angle to the structure. The cap 28 is installed onto the wire rope 10 before the wire rope 10 is installed in the wire stud 26. The wire rope 10 is inserted into the wire stud 26 and crimped. The wire stud 26 is installed by threading the swivel receiver 162 onto the wire stud 26. Then, the cap 28 is forced into the cap end 170 of the swivel receiver 162 so that the O-ring 86 holds the cap 28 in place. The length of the wire rope 10 in the swivel receiver 162 can then be adjusted by turning the swivel receiver 162 about the wire rope 10, where the wire stud 26 will move in either direction based on the direction of turning the swivel receiver 162. The adjustment of the length of the wire rope 10 is usually done after the other end of the wire rope 10 is attached to a structure using a fixed connecting assembly.

Figure 19:
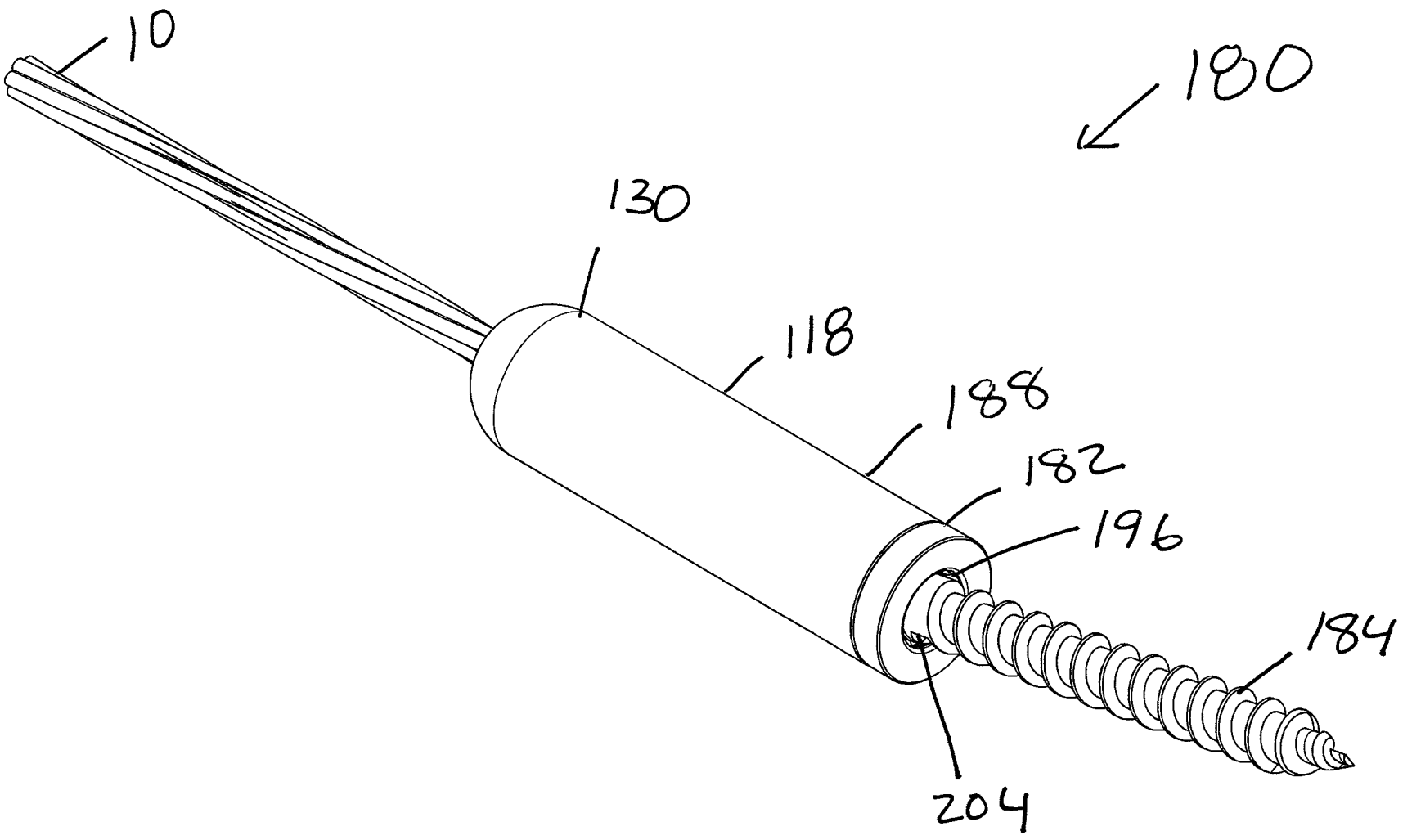
FIG. 19 is a perspective view of a screw solid cable connecting assembly according to the present invention.
Figure 20:
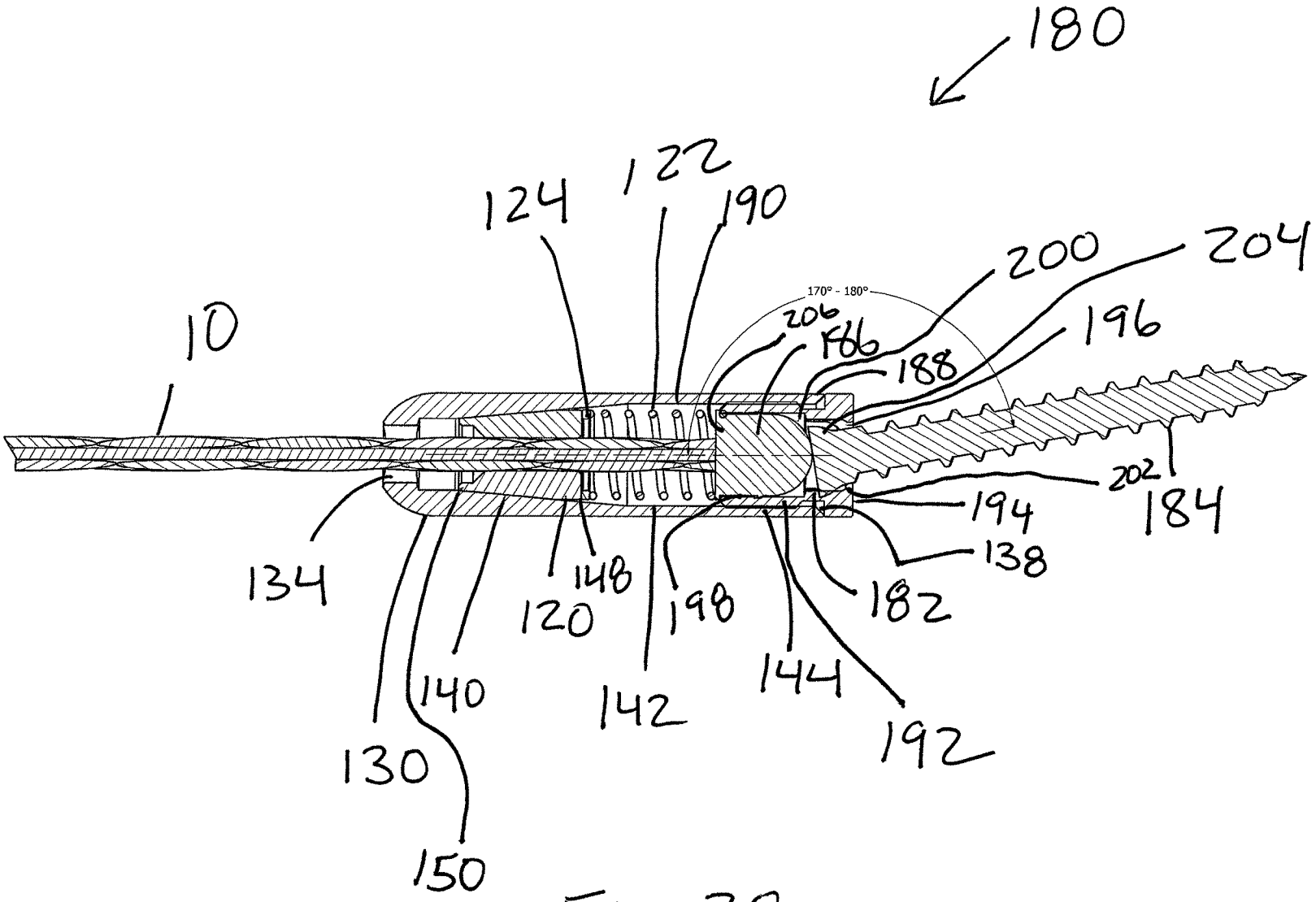
FIG. 20 is a cutaway view of a screw solid cable connecting assembly according to the present invention.
Figure 21:
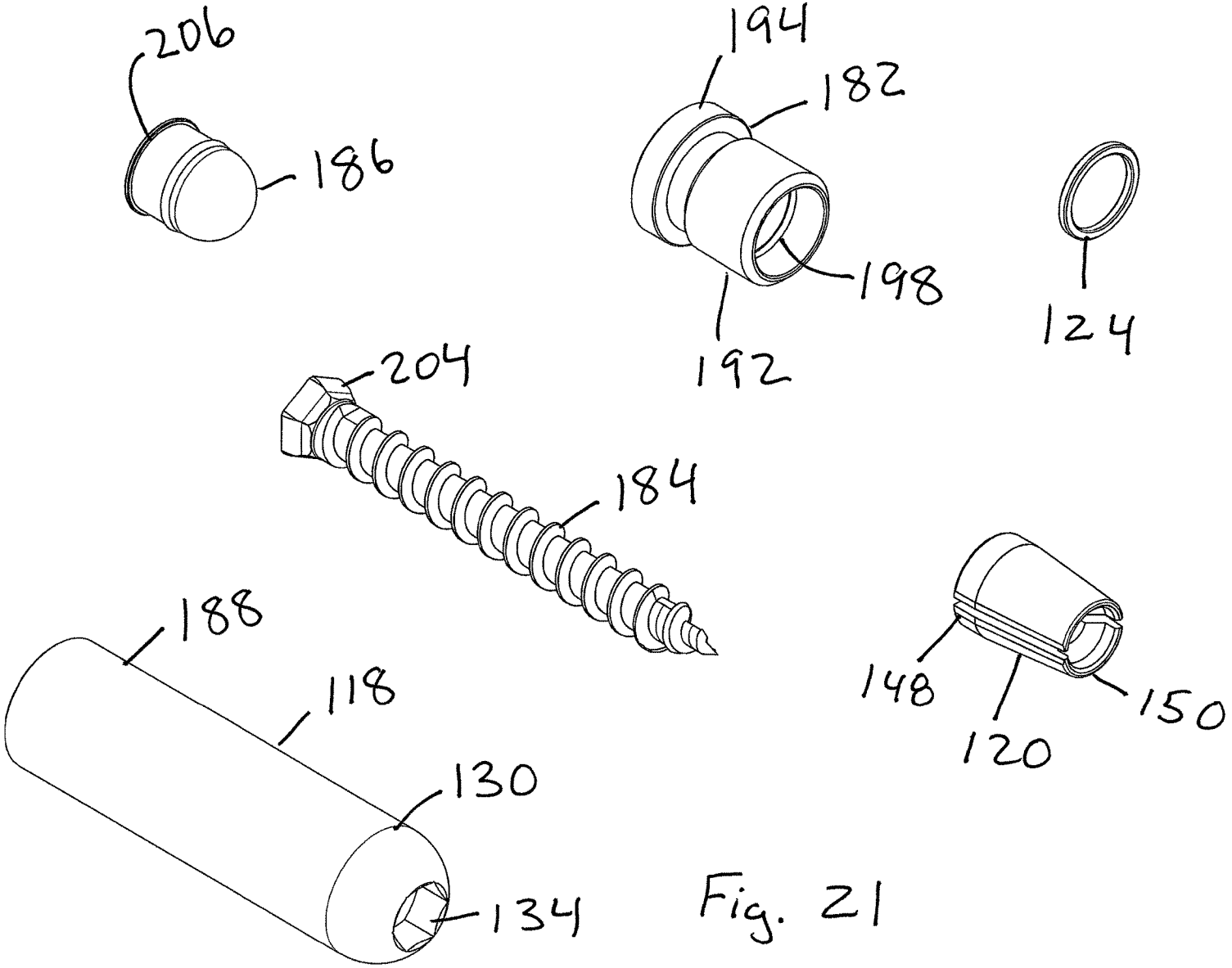
FIG. 21 is an exploded perspective view of a screw solid cable connecting assembly according to the present invention.

FIGS. 19-21 show the components of a screw solid cable connecting assembly 180 that attaches to a structure and receives a wire rope 10. The screw solid cable connecting assembly 180 is a fixed assembly that does not allow for adjustment of wire rope length once the wire rope 10 is attached to the screw solid cable connecting assembly 180. The screw solid cable connecting assembly 180 includes a feature of self gripping of the wire rope 10. The screw solid cable connecting assembly 180 includes a gripping body 118, a wedge 120, a wedge spring 122, grip washer 124, screw body 182, screw 184 and a plunger 186. The gripping body 118 includes a cap end 130 and a screw body end 188. The gripping body 118 includes wire hole 134 in the cap end 130 to receive a wire rope 10 and a screw body channel 190 that is accessible using an opening 138 in the screw body end 188. The screw body channel 190 includes a wedge section 140, spring section 142 and threaded section 144. The wedge section 140 is near the cap end 130 and increases in width (diameter) from the cap end 130 towards the screw body end 188. The spring section 142 receives the grip washer 122 and wedge spring 124 from the opening 138 in the screw body end 188. The screw body 182 incudes a threaded end 192 and a screw end 194. The screw end 194 includes a screw hole 196 to receive the screw 184. The threaded end 192 includes as opening 198 that leads to a screw channel 200 in the screw body 182. The screw channel 200 leads from the opening 198 to the screw hole 196 to allow insertion of the screw 184 into the screw hole 196 from the opening 198. The screw hole 196 includes a hex shape surface 202 about the screw hole 196 inside the screw body 182. The screw 184 includes a hex shaped head 204 that engages the hex shape surface 202 so that the screw 184 and the screw body 182 interlock with each other. The purpose hex shape of the surface 202 and the screw head 204 is for the interlocking of the two, so that they can be any other shape, as long as they interlock. The two are interlocked so they rotate together. The wedge 120 is shown as a two piece wedge that reduces in width (diameter) from top 148 to bottom 150 of the wedge 120. The plunger 186 is shaped to fit into the screw channel 200 from the opening 198 in the screw body 182. The threaded end 192 of the screw body 182 threads into the threaded section 144 of the gripping body 118. The plunger 186 includes a flat surface 206 to engage the wedge spring 122 as the threaded end 192 moves into the gripping body 118 to put tension on the wedge spring 122.

The screw solid cable connecting assembly 180 of FIGS. 19-21 is installed by starting with an assembled unit. Since the screw head 204 and the gripping body 118 are interlocked, the gripping body 118 can be engaged by a wrench or socket at the wrench slots to screw the screw 184 into the structure. The wire rope 10 is then inserted into the wire hole 134 and pushed past the wedge 120. Once the wire rope 10 is pushed past the wedge 120, the wire rope 10 is pulled away from the cap end 130 to engage the self gripping action of the wedge 120 to lock the wire rope 10 in place.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A connecting assembly for connecting a cable end of a wire rope to a structure, comprising:

a structure attachment interface adapted to mount to the structure at a point on the structure without said connecting assembly exiting the structure at any other point on the structure; and a cable end attachment interface adapted to mount the cable end to the connecting assembly;

further including a swivel receiver, screw, swivel body, wire stud and cap, said swivel receiver includes a swivel body end and a cap end, said swivel receiver includes a threaded stud channel that is accessible from said cap end, said swivel body end includes a screw hole to allow said screw to extend from said swivel body end, said screw hole includes a rounded surface about said screw hole inside said swivel body end, said screw includes a rounded head that engages said rounded surface to allow movement of said screw head in said swivel receiver, said wire stud has a threaded end, a crimpable end and a wire channel, said threaded end threads into said threaded stud channel of said swivel receiver, said wire channel is adapted for receiving the wire rope and said crimpable end adapted to be crimped with the wire rope to retain the wire rope in place, said cap including a wire hole and an insert end, said insert end includes a groove and an O-ring in said groove, and wherein said opening of the cap end of said swivel receiver includes an O-ring cutout to receive said insert end of the cap so that said O-ring retains said cap in place once inserted in said cap end and wherein said wire hole is adapted for allowing wire rope to pass through said cap.

* * * * *